United States Patent [19]

Akers et al.

[11] Patent Number: 4,940,348

[45] Date of Patent: Jul. 10, 1990

[54] PLATEN CONTROLLED SHEETFEED PERMITTING BACK-UP FOR ERASURE

[75] Inventors: Albert L. Akers, Nicholasville; Robert M. Carpenter, Lexington; William D. Freeman, Harrodsburg; John E. Passafiume, Lexington, all of Ky.

[73] Assignee: International Business Machines Corporation, Armonk, N.Y.

[21] Appl. No.: 244,366

[22] Filed: Sep. 15, 1988

[51] Int. Cl.[5] ..... B41J 13/10

[52] U.S. Cl. ..... 400/624; 400/708; 400/551

[58] Field of Search ..... 400/551, 624, 625, 708, 400/670.1, 706, 707, 708.1

[56] References Cited

U.S. PATENT DOCUMENTS

| | | | |
|---|---|---|---|
| 3,828,912 | 8/1974 | Prade | 400/670.1 |
| 4,089,402 | 5/1978 | Hyland et al. | 400/625 |
| 4,564,187 | 1/1986 | Costa et al. | 400/624 |
| 4,583,873 | 4/1986 | Parks et al. | 400/624 |
| 4,585,224 | 4/1986 | Kuzuya | 400/551 |
| 4,655,626 | 4/1987 | Okazaki | 400/605 |
| 4,732,501 | 3/1988 | Angst et al. | 400/708 |
| 4,799,813 | 1/1989 | Steinmaetz | 400/624 |
| 4,812,065 | 3/1989 | Shimagawara et al. | 400/624 |

OTHER PUBLICATIONS

IBM Technical Disclosure Bulletin article entitled "Bidirectional Clutch Spring," vol. 30, No. 4, Sep. 1987 at pp. 1578–1580.

*Primary Examiner*—Edgar S. Burr
*Assistant Examiner*—Motilal P. Patel
*Attorney, Agent, or Firm*—John A. Brady

[57] ABSTRACT

Sensor arm (5) detects paper (1) at the printing stations of a printer (13). The sensor arm is linked through shaft (37) to position ledge (43) where it encounters and extension (47) of spring clutch (31) to decouple the spring clutch. Sheetfeed (11) is both driven and controlled from the platen (3) of the printer. With the spring clutch deactivated by the presence of paper, pawl (39) continues to hold the sheetfeed in an inactive status. In the absence of paper, the sensor arm (5) moves past the printing region, moving the ledge (43) away from contact with the spring clutch. Backward movement of the platen then initiates a sheetfeed cycle by movement of gear (35) being transmitted through the spring clutch (31).

3 Claims, 3 Drawing Sheets

PLATEN CONTROLLED SHEETFEED PERMITTING BACK-UP FOR ERASURE

TECHNICAL FIELD

This invention relates to paper feeding systems primarily for typewriters in which printing on the paper may be erased. To erase errors anywhere on the paper, the platen is reversed to position such errors at the erasing mechanism. Platen reversal also may be used to trigger the initiation of the feeding of the sheet, and also may be used to select between two or more bins for feeding. This invention permits such platen reversal for control operations while still permitting back up for erasure.

BACKGROUND ART

Triggering initiation of a sheetfeed operation from backward movement of the platen of the printer with which the sheetfeed is mounted is a standard alternative. Illustrative of such a sheetfeed is is *IBM Technical Disclosure Bulletin* article entitled "Bidirectional Clutch Spring," Vol. 30, No. 4, Sept. 1987 at pp. 1578–1580. A backward platen movement of a predetermined amount physically moves a latch to free the sheetfeed for feeding one sheet of paper in response to forward platen movement. Such a system avoids electrical connection to the sheetfeed, which may be entirely mechanical.

This invention employs a paper-presence sensor. Such sensors are widely known, but not for purposes of control of a sheetfeed for back up to erase. U.S. Pat. No. 4,655,626 to Okazaki is of general interest with respect to this invention in that it shows paper-presence sensing in a sheetfeed.

DISCLOSURE OF INVENTION

This invention relates to sheetfeeds in which the platen of the printer which the sheetfeed services is reversed to provide control movements to the sheetfeed. Using the platen for control minimizes or eliminates electrical or similar connections to the sheetfeed. Backward movement of the platen, however, can conflict with movements for the purpose of moving the paper in the printer for erasures. This invention employs a paper-presence sensor in the region of the printing to disable the sheetfeed response to platen control movements. In the embodiment disclosed paper-presence locates a member at a position at which it blocks the tab of a spring in a spring clutch in the sheetfeed, thereby disabling mechanisms which initiate feeding.

BRIEF DESCRIPTION OF DRAWING

Details of this invention will be described in connection with the accompanying drawing, in which.

BEST MODE FOR CARRYING OUT THE INVENTION

Mechanically actuated, semiautomatic typewriter or printer sheetfeeds are typically actuated either through electronic means or by mechanical response to reverse platen line feeding movement or some combination of reverse and forward line feeding of the machine platen. The mechanical system works well generally, but not where backward platen movements may be required for purposes of correction of printed errors. During correction the operator could inadvertently feed a new paper while intending to move the platen for the purpose of repositioning the paper for correction. When the sheetfeed control movement or combination of movements occurs inadvertently, the operator is suddenly faced with the machine ejecting the present sheet of paper and inserting a new sheet.

The clutch inhibit mechanism of this specific embodiment is uniquely designed to allow reverse line feeding of paper in any combination on typewriters or printers with platen-movement-controlled, semiautomatic sheetfeeds. It operates by mechanically sensing the presence of paper in the printing region of the machine, then using this information to allow or prevent clutch connection. When paper is not present in the machine, the clutch is allowed to connect and disconnect in its normal manner. When paper is present in the writing area of the machine, clutch actuation or connection is inhibited.

This embodiment thereby allows full page text erasure or other editing without the possibility of the inadvertent feeding of a second sheet of paper. It may be incorporated with existing sheetfeed mechanism, specifically of a design such as disclosed in the foregoing article entitled "Bidirectional Clutch Spring."

Figure 1:
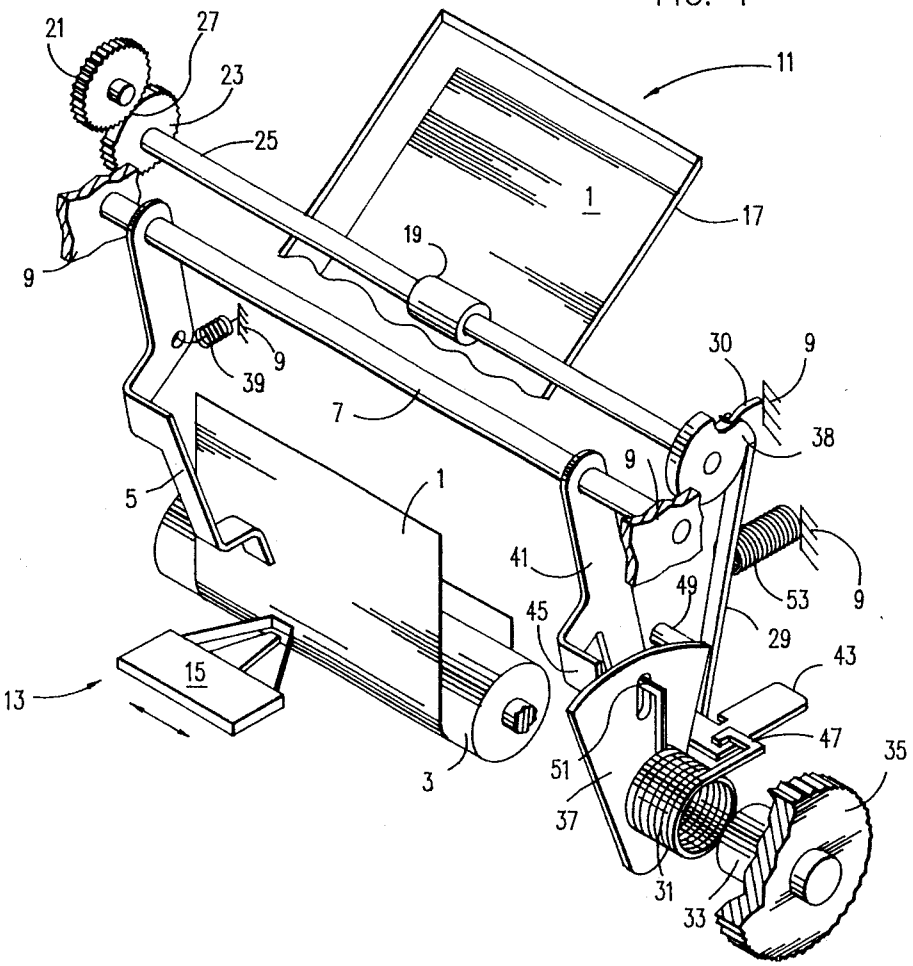
FIG. 1 shows the main elements of the paper-presence sensor and its control of the status of the sheetfeed when paper is sensed.

Referring to FIG. 1, paper 1 mounted in the region for printing on a platen 3 of a printer is contacted by sensor arm 5. Sensor arm 5 is integral with shaft 7 which is pivoted on opposite sides by frame elements 9 of the sheetfeed 11. Sheetfeed 11 may be removably mounted or permanently incorporated with a printer 13, in which platen 3 is employed conventionally as a support for printing by a carrier 15 moveable across paper 1 to effect printing. Carrier 15 typically may carry an erase ribbon which is employed by the printing mechanism to effect erasure, either by cover-up or lift-off, as is now generally conventional.

Sheetfeed 11 comprises one or more bins 17 for stacks of cut sheets of paper 1, from which paper 1 is fed from the top of the stack by feed roll 19 which is both powered and initiated by movement of platen 3. A drive gear 21 is linked directly to platen 3 through a gear train (not shown) and is contiguous to gear 23. Gear 23 is integral with shaft 25 and drives roll 19 in the paper feed direction when platen 3 moves in the top-to-bottom paper feed direction (forward movement). Feed roll 19 may be linked to shaft 25 by an internal, one-way clutch, as is conventional. Gear 23 has a short segment 27 of no teeth, at which gear 21 free wheels until a sheet feed operation is initiated by movement of latch pawl 29 to free gear 23 to move under the force of a bias spring 30 enough to engage teeth of gear 23 with teeth of gear 21, thereby linking shaft 25 to platen 3.

A spring clutch 31 is mounted on the hub 33 of a gear 35 which is driven from platen 3 through a gear train (not shown) which reverses the direction of rotation of gear 35 from that of platen 3. The spring of clutch 31 is wound so that platen 3 movement in the bottom-to-top paper feed direction (reverse movement) tightens the spring of clutch 31 around hub 33. This tightening of clutch 31 links clutch 31 to gear 35, thereby causing gear 35 to rotate clutch arbor 37, mounted with clutch 31, in the direction toward pawl 29 (clockwise in the figures).

In FIG. 1 pawl 29 is engaged with a roll 38 at a ledge on its circumference. Roll 38 is integral with shaft 25 and its ledge is positioned with respect to the no-teeth segment 27 of gear 23 so that in this engaged position gear 21 merely turns without contacting teeth of gear 23. No paper feed from bin 17 occurs because shaft 25 is motionless. Spring 30 rests in a depression of the circumference of roll 38 to provide a rotating force effective when pawl 29 is disengaged.

Sensor arm 5 is biased toward platen 3 by spring 39 but is blocked by the presence of paper 1 and therefore does not move past paper 1. Arm 41, having bottom ledge or abutment 43 and a second, higher ledge or abutment 45, is integral with shaft 7. Arm 41 therefore responds to the presence of paper 1 in the region of printing by being held in a position in which extension 47 of the spring of clutch 31 engages ledge 43. Such engagement unwinds and thereby deactivates clutch 31, resulting in arbor 37 not moving enough for stud 49 on arbor 37 to contact pawl 29.

Paper feed is not initiated until pawl 29 is moved from the ledge of roll 38. Accordingly, as shown in FIG. 1, the presence of paper 1 decouples platen 3 from arbor 37, thereby preventing backward movement of platen 3 from initiating the feeding of paper 1 from bin 17.

Figure 2:
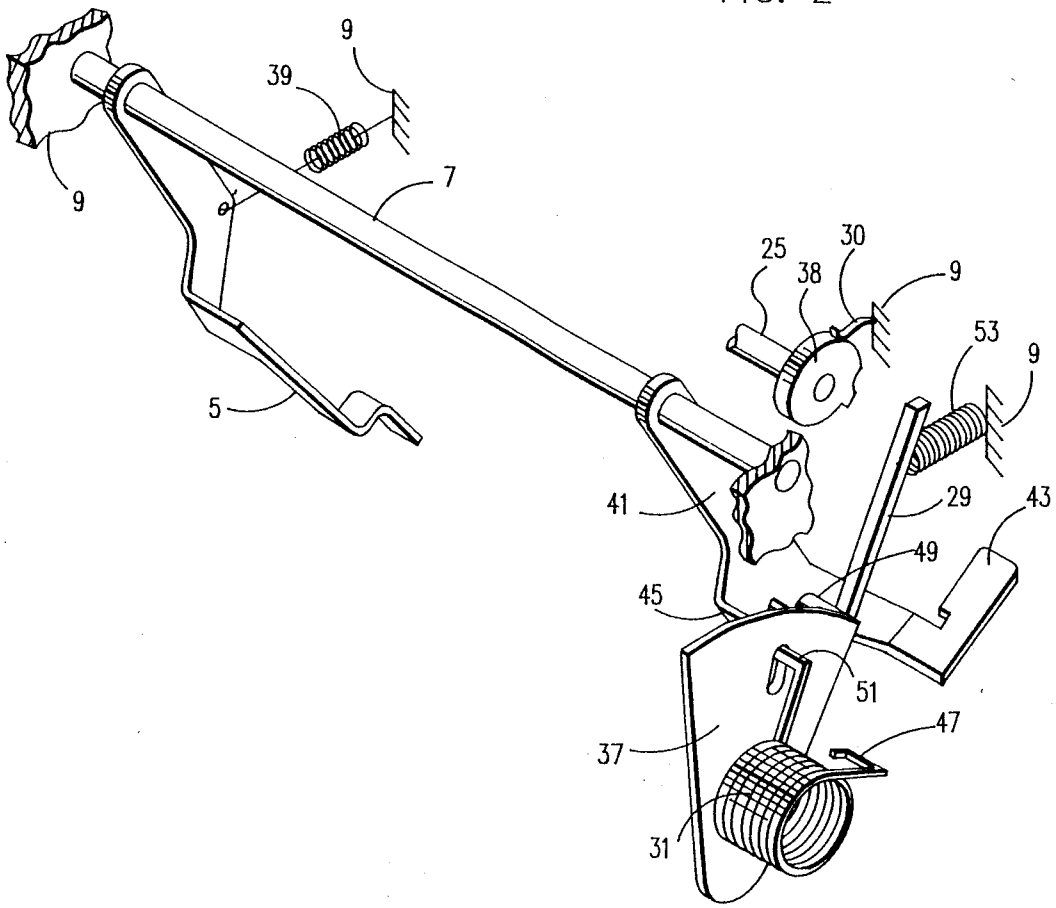
FIG. 2 illustrates pertinent elements of the mechanism of FIG. 1 when paper is not sensed.

FIG. 2 illustrates pertinent elements of this embodiment when the printer does not have paper mounted on platen 1 in the printing region. Typically, this is the status after platen 3 has moved in the forward direction to eject paper after a printing operation. In the absence of paper presence, sensor arm 5 moves past where the paper would be in a counterclockwise direction as shown in FIG. 2. Arm 41, being integral with sensor arm 5 and shaft 7, is also rotated counterclockwise, thereby lifting ledge 43 away from spring clutch extension 47.

When platen 1 is moved backward, clutch 31 tightens on hub 33 (FIG. 1) of gear 35 and arbor 37 is rotated clockwise. This rotation continues until stud 49 on arbor 41 encounters pawl 29 (FIG. 2) and moves it from engagement with roll 38. (A permanent abutment, not shown, may be located to engage extension 47 when backward movement is continued past the amount to disengage pawl 29, thereby terminating arbor 37 movement.)

Disengagement of pawl 29 initiates status of sheet feed 11 for feeding a sheet of paper 1 from bin 17 in a single cycle. Spring 30 moves roll 38 a short distance sufficient to move shaft 25 enough to engage teeth of gear 23 (FIG. 1) with those of gear 21. Movement of platen 3 is changed to forward movement, and gear 21 then drives gear 23 through one revolution, during which roller 19 rotates one revolution to frictionally move one sheet of paper 1 from the bin 17.

Figure 3:
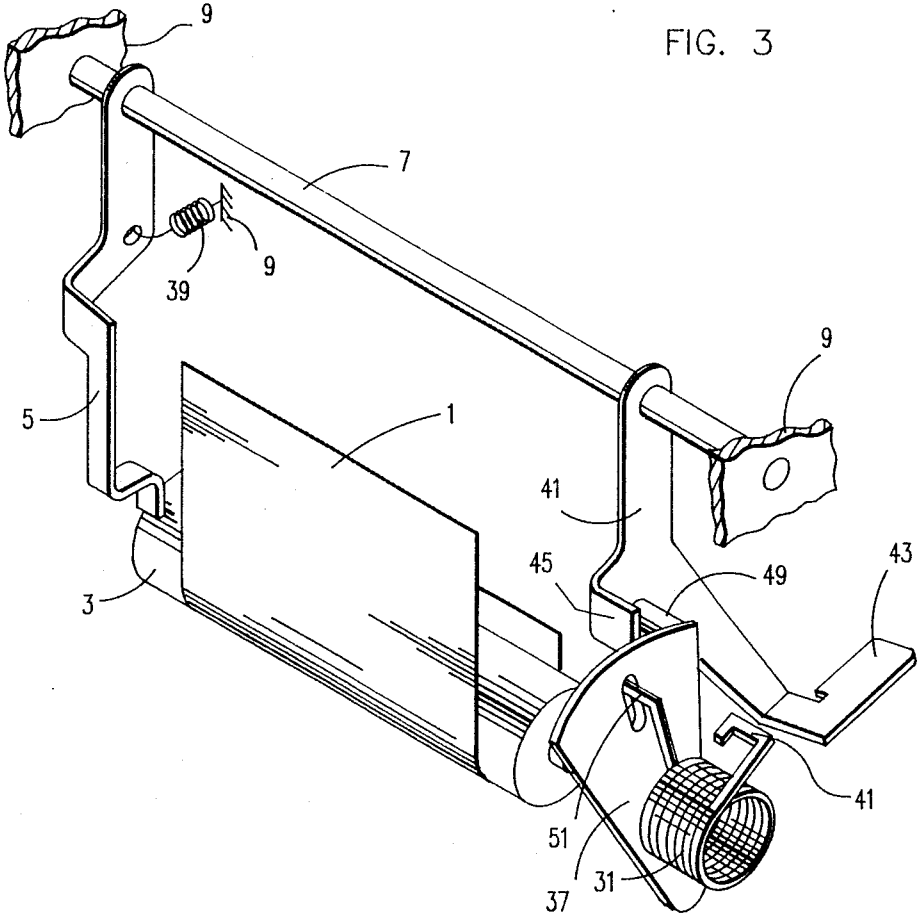
FIG. 3 illustrates pertinent elements of the mechanism of FIG. 1 when paper is being moved forward in the printer.

During the forward movement of platen 3, gear 35 moves in the counterclockwise direction, and the frictional forces between hub 33 of gear 35 with clutch 31 are sufficient to move clutch 31 with hub 33, thereby moving arbor 37 toward its starting position. When stud 49 engages ledge 45 on arbor 41 (FIG. 3), extension 51 of the spring of clutch 31 is pressured toward unwinding of clutch 31, and further forward movement results in slipping at hub 33. The return force is sufficient to overcome spring 39 and therefore move sensor arm 5 outward to permit free movement of paper 1 into the printing region, as shown in FIG. 3. Pawl 29 (FIG. 1 and FIG. 2) is moved toward roll 38 under the bias of spring 53.

At the end of this one cycle, roll 38 is stopped by pawl 29 engaging its ledge. Gear 23 is not under force because its no-teeth segment 27 faces gear 21. Spring 30 is once again positioned to bias roll 38, but is ineffective until pawl 29 is moved away. Platen 3 continues forward movement to feed paper 1, to print on paper 1 across its surface if desired, and to eject paper 1. Any backward movement during printing, such as for erasure, occurs when paper 1 is present on platen 3, and is ineffective to disengage pawl 29 as discussed in detail initially in connection with FIG. 1. Platen 3 may therefore move forward or backward as described with no initiation of paper feed, except when it moves backward in the absence of paper presence as just discussed.

The use of paper presence sensing will be recognized in accordance with the foregoing to be applicable to sheetfeeds and printers of widely varying type and mechanism. Accordingly, the foregoing description is generalized and illustrative with respect to the sheetfeed and the printer. Patent coverage in commensurate with the spirit of this invention is sought, with particular reference to the following claims.

What is claimed is:

1. A printer having a printing region and means to position paper for receiving printing from said printer at said printing region, a first abutment, means for sensing the presence of paper in said printing region, means biasing said means for sensing for movement, which movement is prevented by the presence of paper being sensed, means responsive to said means for sensing to move said first abutment when paper is sensed by said means for sensing, a sheetfeed for supplying paper to said printing region, means responsive to movement of said means to position paper to initiate operation of said sheetfeed by a movement of said means to position paper to feed paper from bottom-to-top, and means to disable said sheetfeed from supplying paper, said sheetfeed comprising a spring clutch and said means to disable comprising said first abutment engaging said spring clutch to unwind said spring clutch positioned for said unwinding by said movement of said first abutment in response to said means to sensing.

2. The printer as in claim 1 in which said spring clutch frictionally connects said sensing member and paper moving means of said printer so that movement of said paper moving means to feed paper from top-to-bottom moves said sensing means to a position away from the position at which said paper is sensed in said printing region, said sheetfeed also comprising a second abutment which engages said spring clutch to unwind said spring clutch and terminate said movement of said sensing means at a position away from the position at which said paper is sensed by engaging said spring clutch to unwind said spring clutch.

3. The printer as in claim 2 in which said second abutment is mounted on said means for sensing and said frictional connection is sufficient to move said means for sensing against a bias for a limited distance, after which said engagement with said second abutment has sufficient force to unwind said spring clutch to reduce said frictional connection and terminate said movement of said sensing means.

* * * * *